US008573003B2

(12) United States Patent
Kaupp

(10) Patent No.: US 8,573,003 B2
(45) Date of Patent: Nov. 5, 2013

(54) JEWELRY ARTICLE WITH REPLACEABLE ORNAMENTS

(75) Inventor: John Kaupp, Rochester, NY (US)

(73) Assignee: J.K. Jewelry, Inc., Rochester, NY (US)

( * ) Notice: Subject to any disclaimer, the term of this patent is extended or adjusted under 35 U.S.C. 154(b) by 313 days.

(21) Appl. No.: 12/584,714

(22) Filed: Nov. 23, 2009

(65) Prior Publication Data

US 2011/0120188 A1 May 26, 2011

(51) Int. Cl.
*A44C 11/02* (2006.01)

(52) U.S. Cl.
USPC ..... 63/3.1; 63/38; 63/40; 63/900; 24/303

(58) Field of Classification Search
USPC ..... 63/12, 3.1, 3, 40, 900, 38; 24/303
See application file for complete search history.

(56) References Cited

U.S. PATENT DOCUMENTS 4,562,704 A * 1/1986 Benedek et al. ..... 63/3.1
6,357,261 B1 * 3/2002 Cheng ..... 63/3.1
6,901,771 B2 * 6/2005 Ooide ..... 63/26
7,007,507 B2 * 3/2006 Enevoldsen ..... 63/3.1
7,540,172 B2 * 6/2009 Julkowski et al. ..... 63/3
7,802,448 B2 * 9/2010 Chan ..... 63/3.1
2005/0241335 A1 * 11/2005 Scharr ..... 63/3.1
2005/0241336 A1 * 11/2005 Scharr ..... 63/3.1
2008/0256978 A1 * 10/2008 Chan ..... 63/3.1
2009/0013720 A1 * 1/2009 Altick ..... 63/3.1
2010/0030265 A1 * 2/2010 Ambrite ..... 606/236

* cited by examiner

*Primary Examiner* — Robert J Sandy
*Assistant Examiner* — Louis Mercado
(74) *Attorney, Agent, or Firm* — Feldman Law Group, P.C.; Stephen E. Feldman

(57) ABSTRACT

An article of jewelry with interchangeable ornaments has an elongated support or a strand that has a proximal end that is permanently affixed to a first ring cap mad a distal end that is removably affixed to a second ring cap. The second cap has female threads that threadably engage/disengage with a male threaded plug defined on the distal end of the strand to facilitate slidable insertions/removal of ornaments and smart beads. The first ring cap includes a clasp that is attachable to a loop of the second ring cap to define a closed position of the article. The first and second ring caps may include magnets that magnetically attach to each other that define an inbuilt clasp for the article.

12 Claims, 8 Drawing Sheets

JEWELRY ARTICLE WITH REPLACEABLE ORNAMENTS

BACKGROUND OF THE INVENTION

"A mechanically/magnetically connectable jewelry article that has an elongated strand that includes at least one threadably removably positionable end portion adapted to facilitate at least one ornament to be slidably positioned on or off the strand."

FIELD OF THE INVENTION

This invention relates to jewelry articles, and more particularly to an article that includes interchangeable ornaments for the personal customization.

DESCRIPTION OF RELATED ART

The conventional jewelry systems typically add and/or remove beads by having to individually screw and unscrew each individual bead for stringing the beads along a strand, and utilize threaded keepers, threaded bands and hinged keepers to lock beads in place. However, these systems are tedious to use. For example, U.S. Pat. No. 7,007,507 discloses necklaces and bracelets with keepers. The keepers are removably attached to bands fixed at intervals on the strands of the necklaces or bracelets. These keepers have internal threads to interact with threaded bands. U.S. Pat. No. 7,007,507 B2 also uses hinged keepers to lock the beads in place in addition to beads which must be threaded over a cylindrical loop on the end of the strand. The threading process requires the use of threaded components or ornaments that are very expensive besides being tedious to use. The threaded system used in these conventional jewelry systems can also be difficult to use for children or people with physical limitations.

The prior art safety catches and/or clasps prevent easy and inadvertent disengagement or detachment of clasping ends and minimize the risk of potential loss of the jewelry. However, fastening of such articles behind the hand/neck require both hands to be used by a user/wearer. In such a situation, said clasps/catches are substantially difficult to open or close. The prior art magnetic clasps with safety catches are external attachments and may hurt the wearer. In addition, exterior orientation of the clasp simply renders them unattractive for some users.

There is a need for a jewelry article that allows for beads and other elements to be taken off and/or on by simply sliding them along the strand without individually having to unscrew each individual bead or string beads along a strand. There is also a need for a jewelry article wherein the beads can be positioned, removed and locked in place in a non-tedious manner by utilizing a threading mechanism that is non-expensive. There is a need for a jewelry article that includes an inbuilt magnetic clasping means adapted to facilitate an easy gripping, opening or closing arrangement for the article.

SUMMARY OF THE INVENTION

The present invention relates to an article of jewelry that includes an elongated support or a strand. The strand has a proximal end that is permanently affixed to a first ring cap that is attached to a clasp through a connecting ring. The strand has a distal end that is permanently attached to a male threaded plug that is removably positionable in a second ring cap defined by the article. The second ring cap is adapted to be unscrewed from the male threaded plug to slide decorative beads, baubles or bangles on and off the strand. The second ring cap defines a loop that connects to the clasp to define a closed position of the jewelry article. The movement of decorative beads and/or other ornaments is restrained on the strand by the use of smart beads.

The objective of the present invention is to provide a jewelry article that allows ornaments, decorative beads and other elements to be replaced from the strand in a simple and non-tedious manner by sliding them off/on the strand. Another objective of the present invention is to use smart beads in accordance with the decorative beads for restraining movement of the decorative beads. Another object of the present invention is to provide magnetic means in accordance with the ring caps for advantageously facilitating an inbuilt clasping means for the jewelry article.

DETAILED DESCRIPTION OF THE INVENTION

Figure 1:
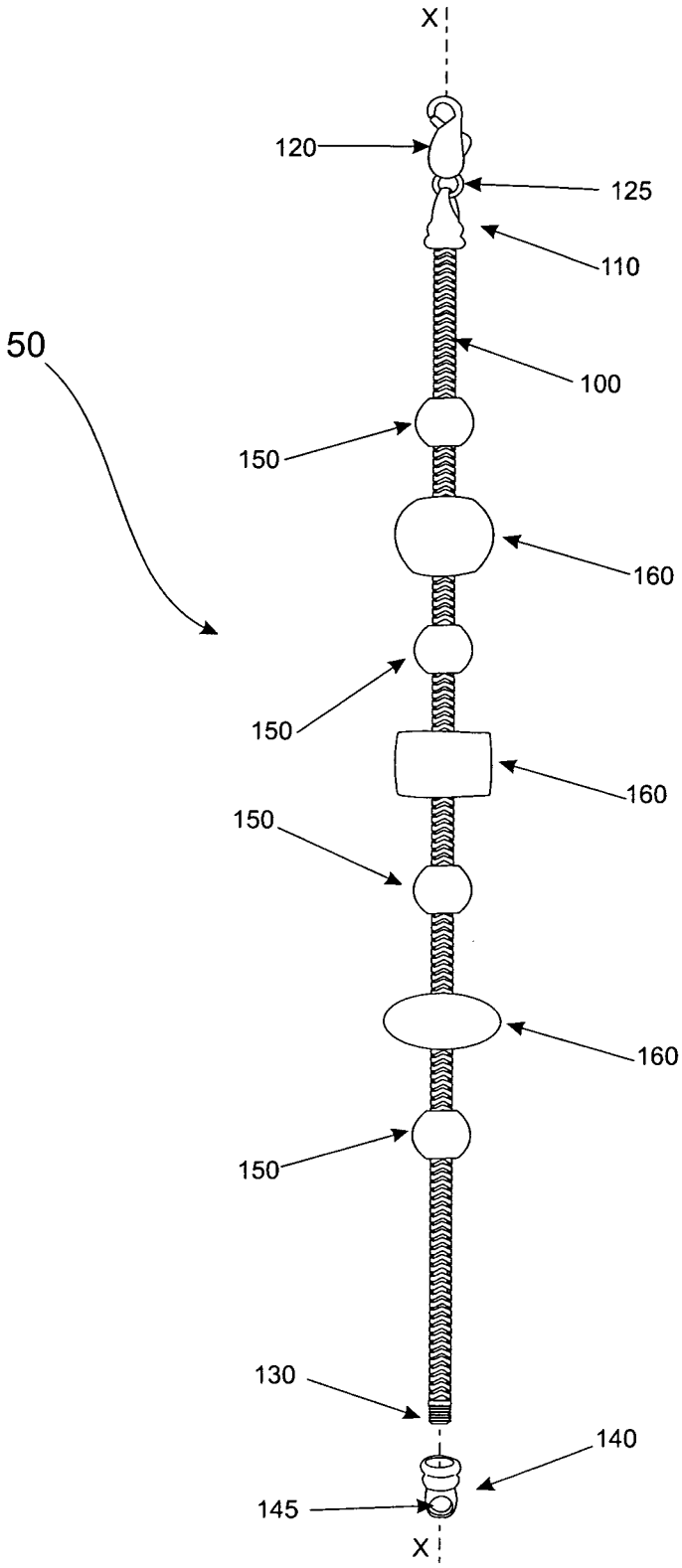
FIG. 1 is an exploded front view of a preferred embodiment of a jewelry article constructed in accordance with the present invention in an open position.
Figure 2:
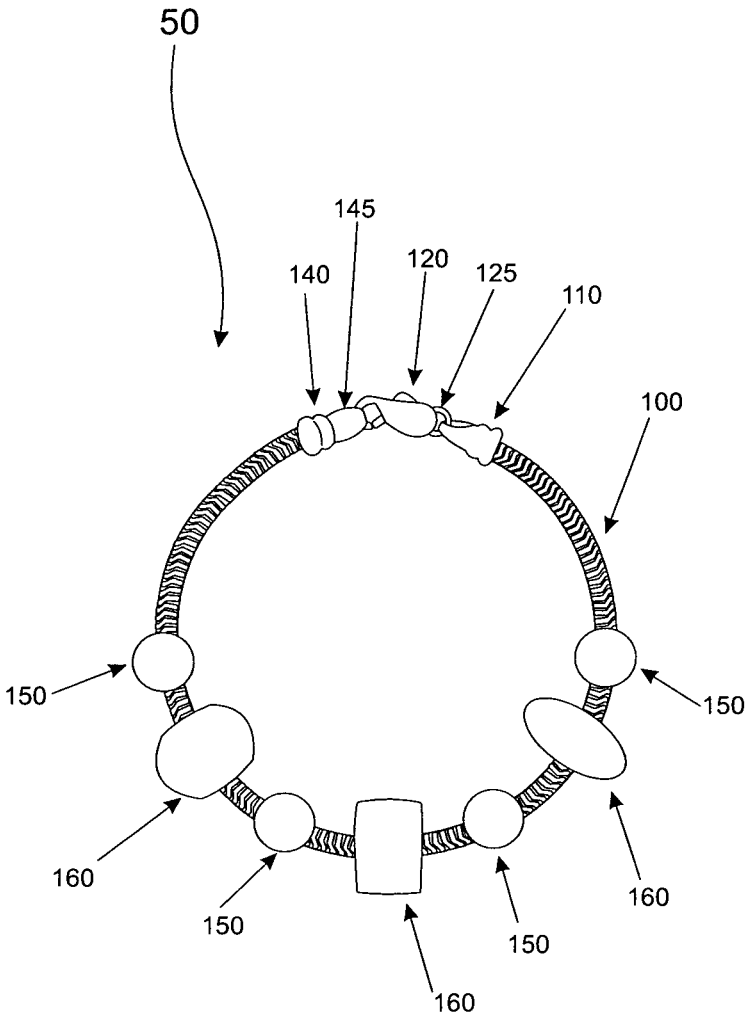
FIG. 2 is a front view of the jewelry article of FIG. 1 in a closed position.

Referring to FIGS. 1-2, an article of jewelry 50 includes an elongated support or strand 100. The elongated support or strand 100 may be made of, but not limited to, any suitable strong, flexible material such as rubber, satin, plastic or silk, or rigid material such as a chain made of silver, gold or steel. Strand 100 is concentrically positioned along a central vertical axis-X. Strand 100 has a proximal end that is permanently affixed to a first ring cap 110. The first ring cap 110 is connected to a clasp 120 through a connecting ring 125. Strand 100 has a distal end that includes a plug 130 that is permanently attached to strand 100. Plug 130 has a plurality of male threads adapted to receive a second ring cap 140 that has a plurality of female threads. The female threaded second ring cap 140 is adapted to be screwed and/or unscrewed on to male threaded plug 130. The cap 140 defines a loop 145 that connects to clasp 120 to define a closed position of article 50. Article 50 has an open, position wherein the clasp 120 is adapted to be disconnected from loop 145. In this one preferred embodiment, article 50 is manually operable between the open and closed positions by a user.

The first ring cap 110 is permanently affixed to strand 100 by soldering this finding onto chain or strand 100. However, it is understood known joining techniques other than soldering can also be employed in other alternative embodiments. Clasp 120 in this one preferred embodiment is a lobster claw clasp. However, it is understood that the other clasps such as a spring ring clasp, a trigger or push lock clasp, a box clasp, and a toggle clasp may be used in other alternative embodiments of article 50.

Figure 3:
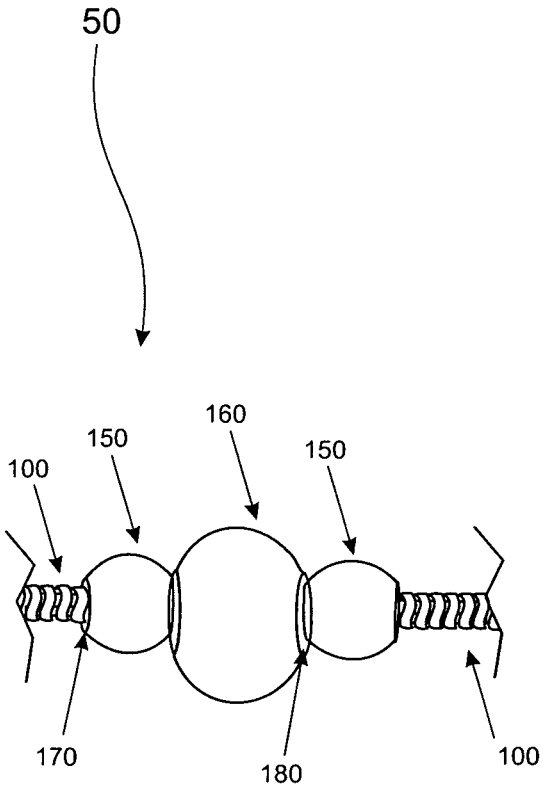
FIG. 3 is a partially enlarged perspective view of a bead portion of the article of FIG. 1.

As shown in FIGS. 2-3, article 50 includes a plurality of customizable smart beads 150 and a plurality of customizable ornaments/decorative beads 160. In this one preferred embodiment, each decorative bead 160 is adapted to be positioned within two smart beads 150. However, it is understood that arrangement of beads 150, 160 may substantially vary per intended application of article 50. It is also understood here that the article 50 may not include smart beads 150 in other alternative embodiments of article 50.

Referring again to FIG. 3, each of the beads 160 has a through hole 170 that has a diameter that is relatively larger than the diameter of the strand 100 to allow bead 160 to comfortably slide off/on the strand 100. Each of the smart beads 150 has a through hole 180 that has a diameter that is relatively larger than the diameter of the strand 100 to allow beads 150 to comfortably slide off/on the strand 100. It is understood that many types of adornments for beads 160 can be used such as beads, baubles, bangles or Murano glass beads. It is also understood that the decorative beads 160 can be made of various materials such as silver, crystal, pearl or hand painted glass.

Figure 4:
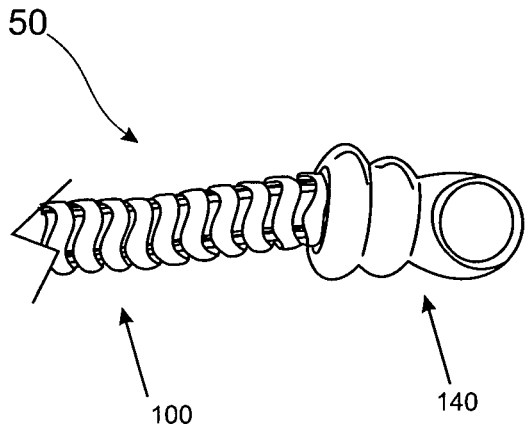
FIG. 4 is a partially enlarged perspective view of a second cap portion of the article of FIG. 1.
Figure 5:
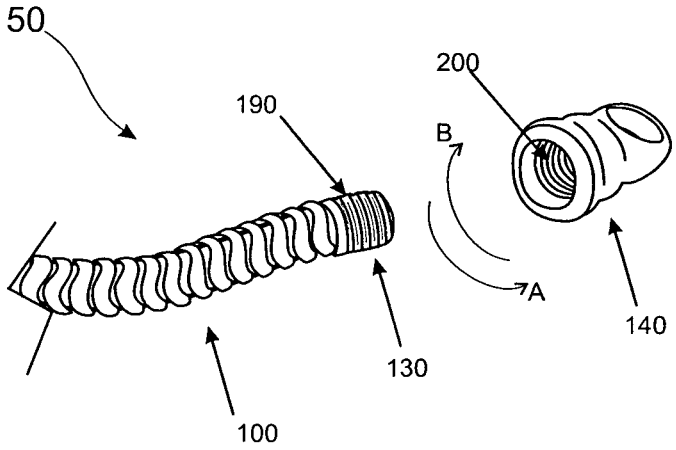
FIG. 5 is a partially enlarged and exploded perspective view of the second cap portion of the article of FIG. 1.

As shown in FIGS. 4 and 5, second ring cap 140 has an unlocked position and a locked position. Plug 130 has an outer surface that includes a plurality of male threads 190. The ring cap 140 has an inner surface that includes a plurality of female threads 200. The threads 190, 200 preferably engage and/or disengage with each other to respectively define locked and/or unlocked positions of cap 140. In this one preferred embodiment, cap 140 is preferably adapted to be rotated over plug 130 in a counterclockwise direction indicated by an arrow-A to disengage threads 190, 200 while unscrewing or removing cap 140 from strand 100. In this one preferred embodiment, cap 140 is preferably adapted to be rotated over plug 130 in a clockwise direction indicated by an arrow-B to engage threads 190, 200 while screwing or positioning cap 140 on strand 100.

Figure 6:
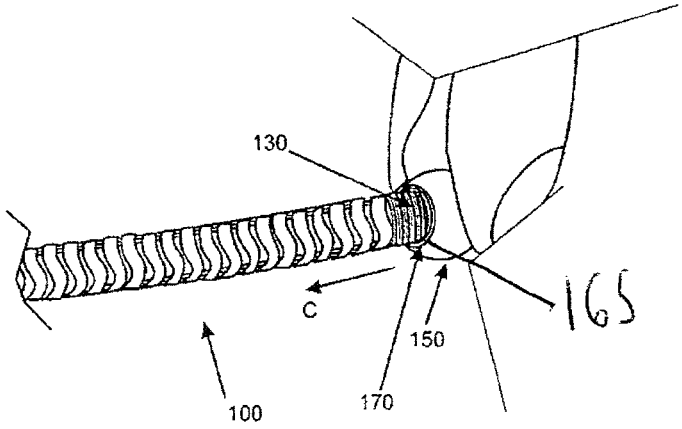
FIG. 6 is a partially enlarged perspective view of the article of FIG. 1 in use for insertion of a first smart bead.
Figure 7:
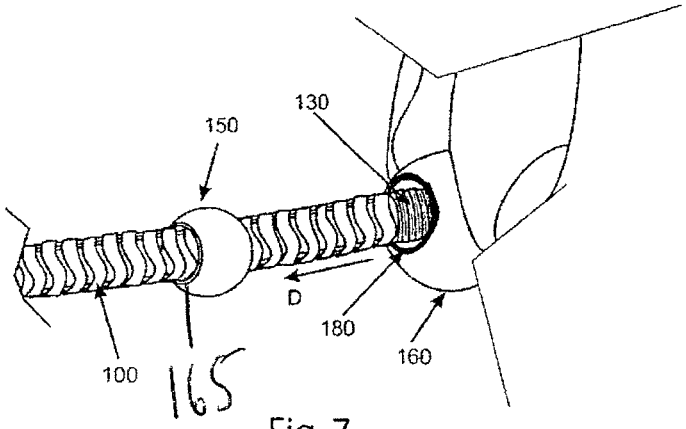
FIG. 7 is a partially enlarged perspective view of the article of FIG. 1 in use for insertion of a decorative bead.
Figure 8:
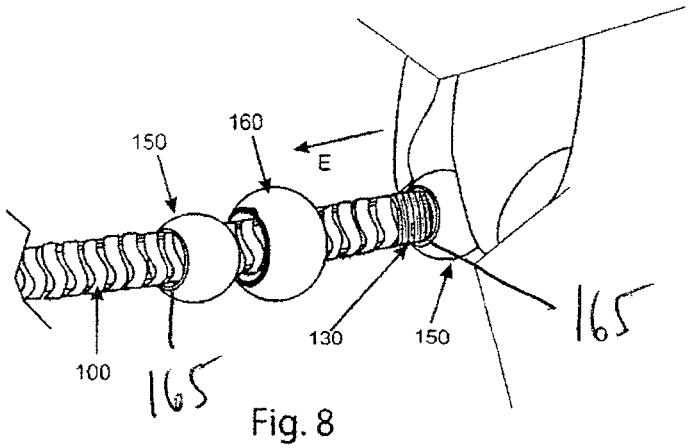
FIG. 8 is a partially enlarged perspective view of the article of FIG. 1 in use for insertion of a second smart bead.

Referring to FIGS. 6-8, beads 150, 160 are adapted to be slidably positioned on strand 100 in the unlocked position of the cap 140. In this preferred embodiment, the smart beads 150 preferably have diameters between 6-10 mm, and most preferably 8 mm. However, it is understood that other sizes of beads 150 may be utilized per intended application of article 50. The user initially slides/inserts a first smart bead 150 through plug 130 in a linear direction indicated by an arrow-C as shown in FIG. 6. The user further slides the decorative bead 160 onto strand 100 in a linear direction indicated by an arrow-D as shown in FIG. 7. The user further slides a second smart bead 150 onto strand 100 in a linear direction indicated by an arrow-E as shown in FIG. 8.

Smart beads 150 are preferably adapted to restrain or prevent movement of the decorative beads 160 in this one preferred embodiment. The smart bead 150 is a self-stopping smart bead that is well known in the art. One such smart bead is outlined in U.S. Pat. No. 6,557,376. Each of the beads 150 has a flexible resilient tube 165 that is positioned inside a shell of bead 150 in alignment with the holes of bead 150. The tube 165 has a length that is either equal to or smaller than the spacing of the holes of bead 150. The tube 165 engages with strand 100 to fix the position of the bead 160 on strand 100 and prevents the movement or slide of beads 160. It is understood here that the number of decorative beads 160 and smart beads 150 may substantially depend on intended application of article 50.

Figure 9:
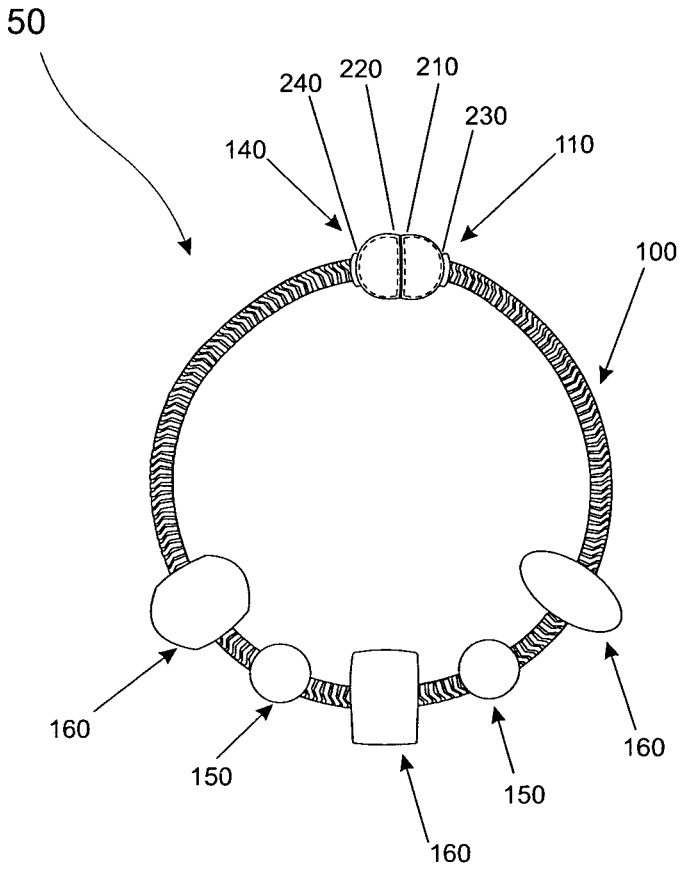
FIG. 9 is an alternative embodiment of the jewelry article of FIG. 1.

Referring to FIG. 9, an alternative embodiment of article 50 is shown. In this one alternative embodiment, first ring cap 110 and second ring cap 140 has front end portions 210, 220 respectively. In this one alternative embodiment, first ring cap 110 and second ring cap 140 also has rear end portions 230, 240 respectively. Front end portions 210, 220 are magnetically attachable to define the closed position of article 50. Rear end portions 230, 240 are removably connectable to/from strand or chain 100.

Figure 10:
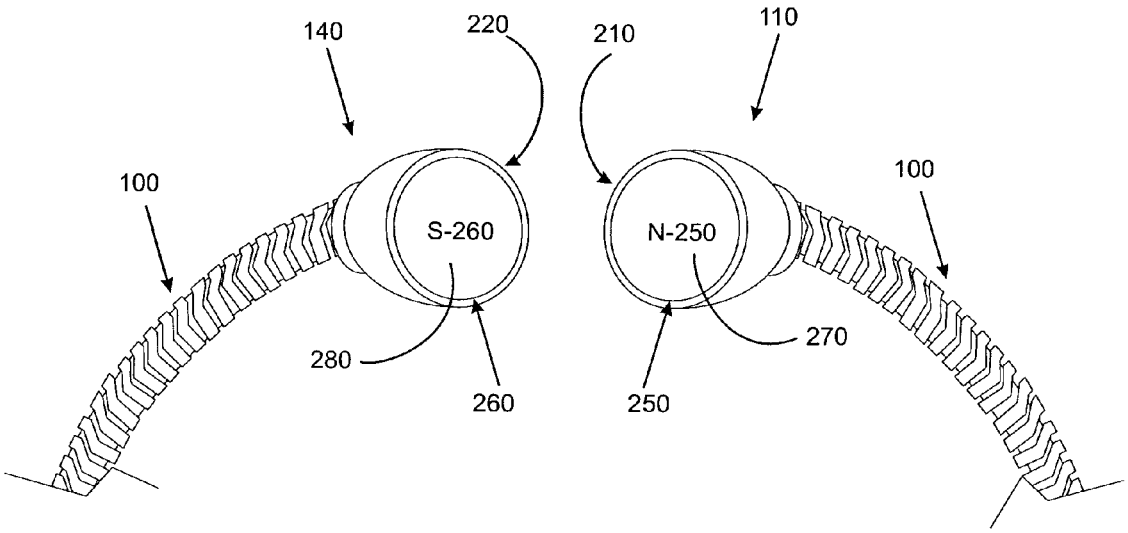
FIG. 10 is a partially enlarged front perspective view of the first and second cap portions of the jewelry article of FIG. 9.

As shown in FIG. 10, front end portion 210 of cap 110 defines a cavity that includes a first magnet 250. Front end portion 220 of cap 140 defines a cavity that includes a second magnet 260. Magnets 250, 260 are preferably adhesively secured into front end portions 210, 220. However, it is understood that magnets 250, 260 may be secured within front end portions 210, 220 using alternative techniques such as crimping and soldering. Magnets 250, 260, in this one preferred embodiment, are preferably made of permanent magnetic material such as Sintered Neodymium Iron Boron (NdFeB) N50. However, it is understood that Magnets 250, 260 may be made of permanent magnetic materials such as, for example, Samarium cobalt, Alnico Ceramic, and Ferrite. The Magnet 250 has a North Pole N-250 that is flushed or aligned with front end portion 210 to define a first magnetically attractive surface 270. Magnet 260 has a south pole S-260 that is flushed or aligned with front end portion 220 to define a second magnetically attractive surface 280. Caps 110, 140 are adapted to be substantially aligned along a common axis such that South Pole S-260 of magnet 260 comfortably aligns or engages with North Pole N-250 of magnet 250 such that first magnetically attractive surface 270 magnetically attaches to second magnetically attractive surface 280 to define a locking arrangement of article 50.

Figure 11:
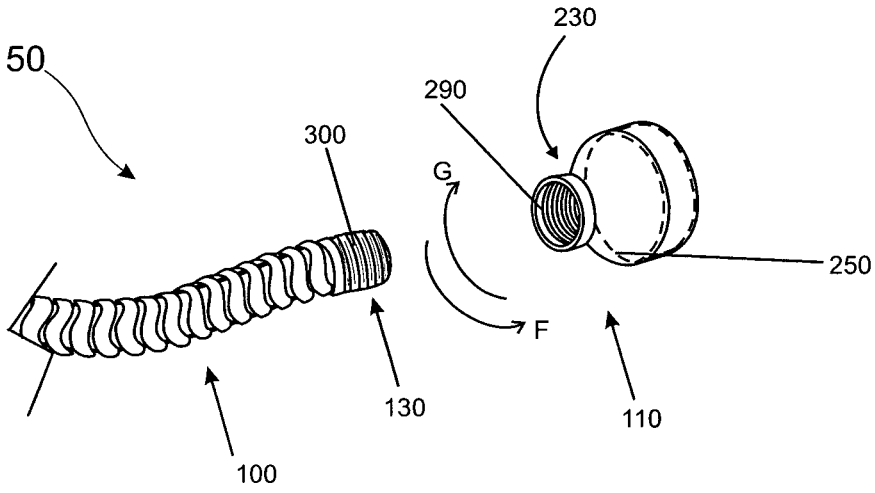
FIG. 11 is a partially enlarged and exploded rear perspective view of the first cap portion of the jewelry article of FIG. 9.

Referring to FIG. 11, rear end portion 230 of first ring cap 110 in this alternative embodiment has a plurality of female threads 290 that are preferably adapted to be rotatably engaged or disengaged with a plurality of male threads 300 of plug 130 to respectively define a locked or an unlocked position of cap 110. Cap 110 is preferably adapted to be rotated over plug 130 in a counterclockwise direction indicated by an arrow-F to disengage threads 290, 300 while unscrewing or removing cap 110 from strand 100. Cap 110 is preferably adapted to be rotated over plug 130 in a clockwise direction indicated by an arrow-G to engage threads 290, 300 while screwing or positioning cap 110 on to strand 100. However, it is understood here that cap 110 may be permanently attached to strand 100 in other alternative embodiments of article 50.

Figure 12:
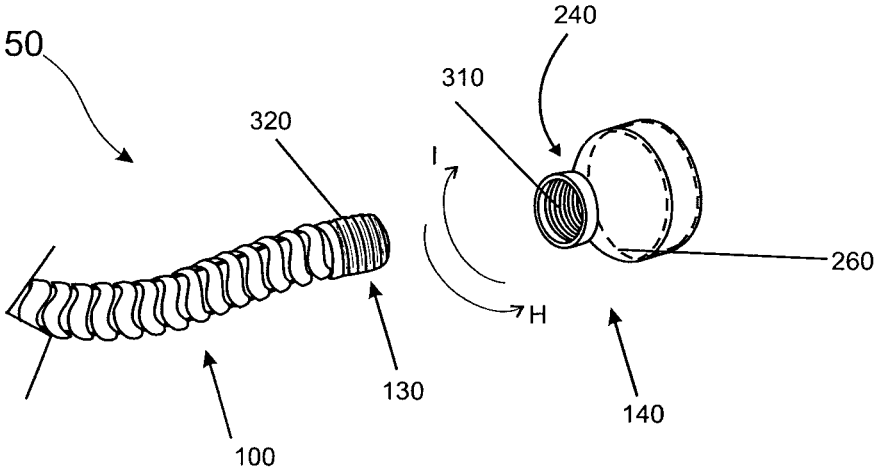
FIG. 12 is a partially enlarged and exploded rear perspective view of the second cap portion of the jewelry article of FIG. 9.

Referring to FIG. 12, rear end portion 240 of cap 140 in this alternative embodiment has a plurality of female threads 310 that are preferably adapted to be rotatably engaged or disengaged with a plurality of male threads 320 of plug 130 to define a locked or an unlocked position of cap 140. Cap 140 is preferably adapted to be rotated over plug 130 in a counterclockwise direction indicated by an arrow-H to disengage threads 310, 320 while unscrewing or removing cap 140 from strand 100. Cap 140 is preferably adapted to be rotated over plug 130 in clockwise direction indicated by an arrow-I to engage threads 310, 320 while screwing or positioning cap 140 on to strand 100. However, it is understood here that cap 140 may be permanently attached to strand 100 in other alternative embodiments of article 50.

Referring to FIGS. 1-12, in operation, the article 50 can be a necklace, bracelet, anklet, belt or other elongated support that advantageously allows for the personal customization by the easy removal or addition of beads, baubles or bangles or other ornaments. The ring cap 110, 140 include magnets 250, 260 that advantageously facilitate an inbuilt clasping means for the ornament 50 and eliminate the need of using clasp 120. The smart beads 150 advantageously prevent the movement of beads 160 that are strung on the elongated support 100. The use of male-female arrangement in accordance with removable second ring cap 140 advantageously allows ornament 50 to be effortlessly modified/redecorated and significantly reduces the time required for replacement of beads 150,160. Therefore, jewelry articles in accordance with the present invention are readily and quickly customizable per the whims and fancies of the user.

The foregoing description of the preferred embodiments of the present invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

Since many embodiments of the present disclosure can be made without departing from the spirit and scope of the present invention, the present invention resides in the claims hereafter appended. It is also to be understood that the following claims are intended to cover all of the generic and specific features of the invention described herein.

The invention claimed is:

1. A jewelry article comprising:

an elongated strand, the elongated strand having an outer diameter;

a plug located on an end of the elongated strand, the plug having an outermost diameter that is equal to the outer diameter of the elongated strand, the plug having male threads:

a second ring cap, the second ring cap having female threads on an interior surface of the second ring cap, the female threads being sized for mating with the male threads of the plug;

at least one bead, the at least one bead having a through hole; and a flexible resilient tube, the flexible resilient tube being positioned within the through hole of the at least one bead, wherein the at least one bead is slidably positioned on the elongated strand with the flexible tube engaging the elongated strand so as to fixedly position and prevent movement of the at least one bead on the elongated strand.

2. The jewelry article of claim 1 wherein the second ring cap has loop.

3. The jewelry article of claim 2 further comprising:

a first ring cap, the first ring cap being permanently affixed to an end opposite the plug.

4. The jewelry article of claim 3 further comprising:

a connecting ring, and a clasp, the connecting ring connecting the clasp to the first ring cap.

5. The jewelry article of claim 4 wherein the clasp of the first ring cap mates with the loop of the second ring cap to define a locking arrangement for the jewelry article.

6. The jewelry article of claim 1 wherein the second ring cap includes a cavity and a magnet held within the cavity.

7. The jewelry article of claim 6 further comprising:

a first ring cap, the first ring cap including a cavity and a magnet held within the cavity, wherein the magnet of the first ring cap and the magnet of the second ring cap define a locking arrangement for the jewelry article.

8. The jewelry article of claim 1 further comprising:

at least one ornament.

9. The jewelry article of claim 8 wherein the jewelry article is a bracelet.

10. The jewelry article of claim 8 wherein the jewelry article is a necklace.

11. The jewelry article of claim 8 wherein the jewelry article is an anklet.

12. The jewelry article of claim 8 wherein the jewelry article is a earring.

* * * * *